United States Patent [19]

Yamamura et al.

[11] Patent Number: 4,457,156

[45] Date of Patent: Jul. 3, 1984

[54] HORIZONTAL TUBE UPSETTER

[75] Inventors: Takashige Yamamura, Kobe; Satosi Matsumoto, Toyonaka, both of Japan

[73] Assignee: Kabushiki Kaisha Kobe Seiko Sho, Kobe, Japan

[21] Appl. No.: 343,217

[22] Filed: Jan. 27, 1982

[30] Foreign Application Priority Data

Jan. 29, 1981 [JP] Japan ..... 56-12844[U]

[51] Int. Cl.[3] ..... B21D 41/02

[52] U.S. Cl. ..... 72/316; 72/357; 72/453.01; 72/453.03; 72/441

[58] Field of Search ..... 72/305–307, 72/316, 317, 357, 358, 352, 353, 404, 432, 465, 441, 453.01, 453.03

[56] References Cited

U.S. PATENT DOCUMENTS 2,682,186 6/1954 Remenschneider ..... 72/478
3,100,409 8/1963 Esser et al. ..... 72/357
3,354,694 11/1967 Schwartz ..... 72/452
3,680,339 8/1972 Hayakawa ..... 72/441

FOREIGN PATENT DOCUMENTS 1045074 10/1966 United Kingdom ..... 72/316

*Primary Examiner*—Daniel C. Crane
*Attorney, Agent, or Firm*—Oblon, Fisher, Spivak, McClelland & Maier

[57] ABSTRACT

An upsetter of the horizontal type which has in a horizontal row a plurality of split dies which include upper movable dies and lower fixed dies each having a clamp die section and an upset die section, the upsetter including a number of piece dies separately constituting the clamp die sections of the movable dies and hydraulic cylinders for operating the clamp die sections independently of each other.

11 Claims, 24 Drawing Figures

FIGURE 1 *PRIOR ART*
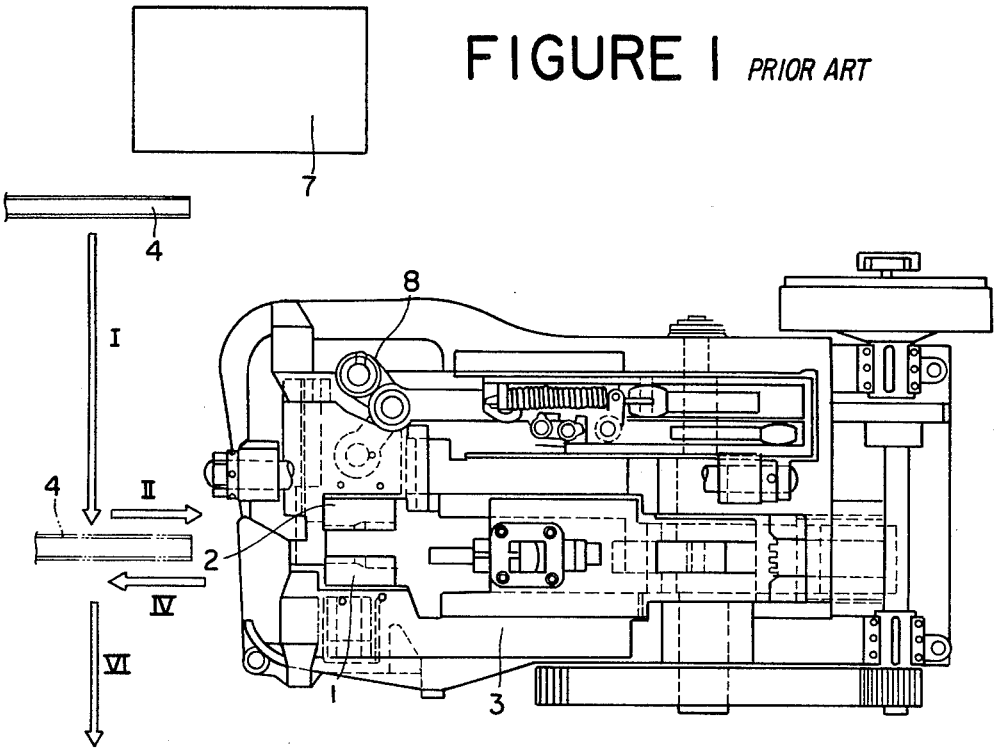
FIGURE 2 *PRIOR ART*
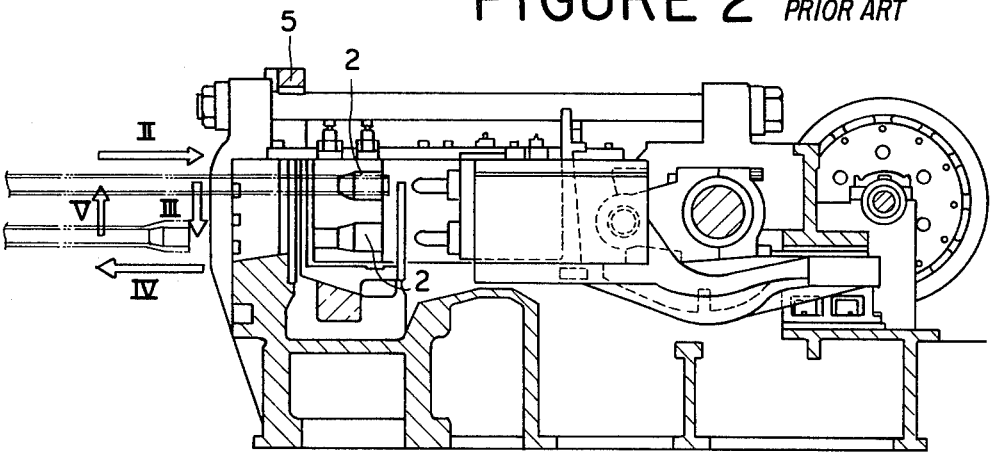

FIGURE 5 *PRIOR ART*
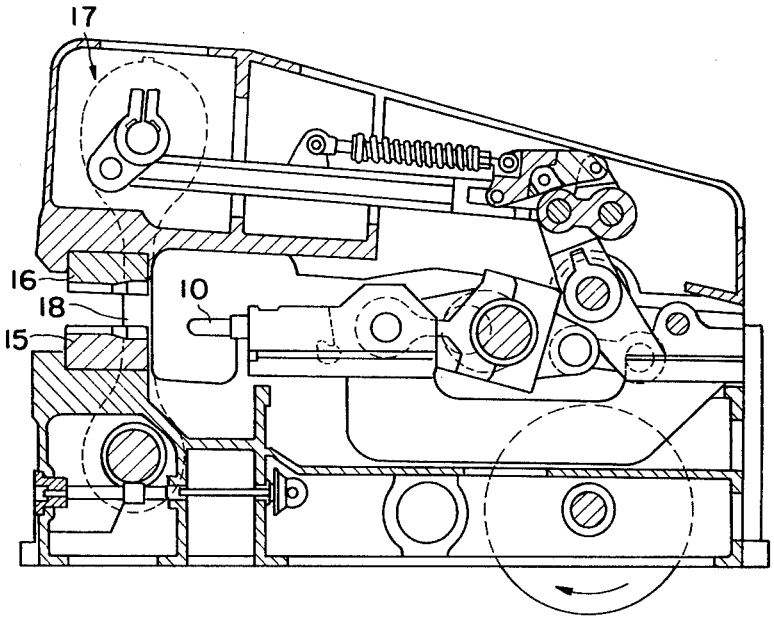

FIGURE 7(a)
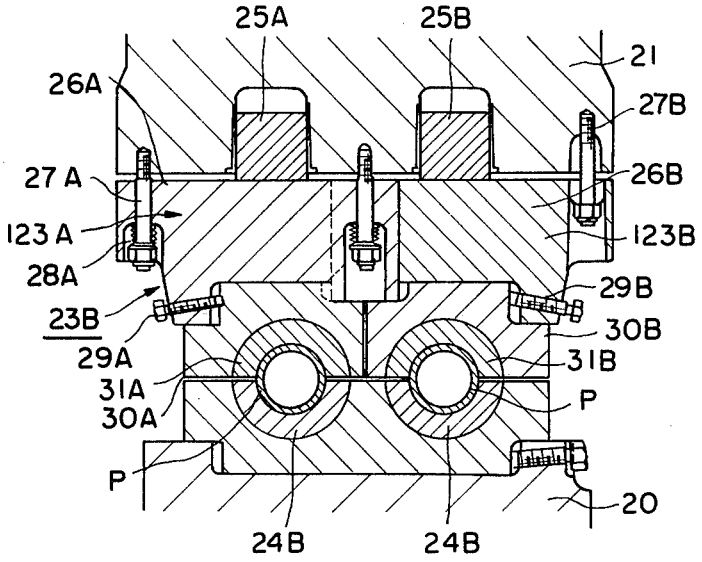
FIGURE 7(b) *PRIOR ART*
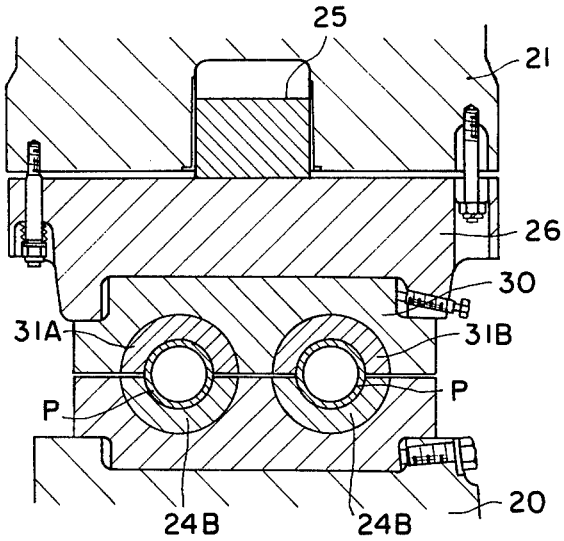

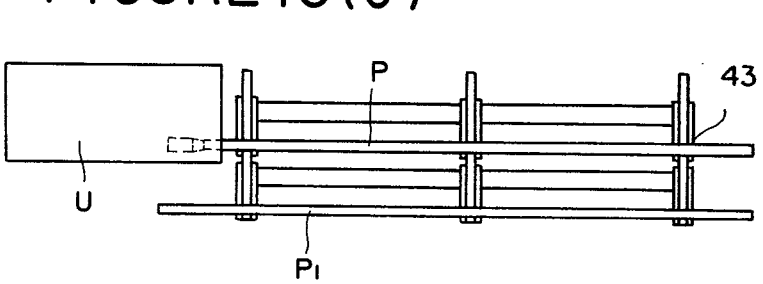
FIGURE 10(c)
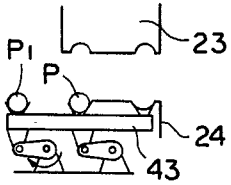
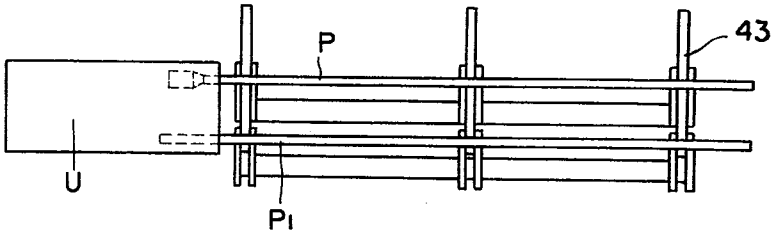
FIGURE 10(d)
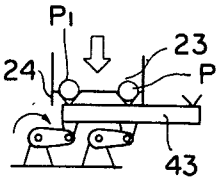

FIGURE 10(e)
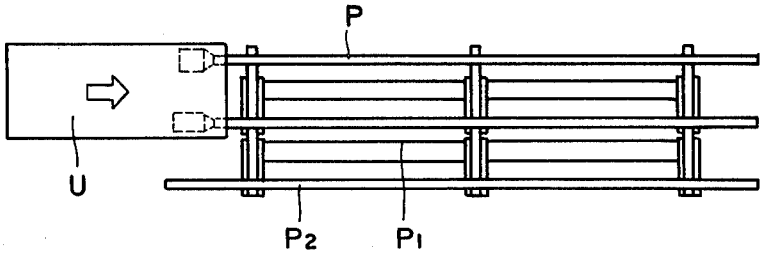
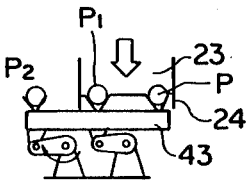
FIGURE 10(f)
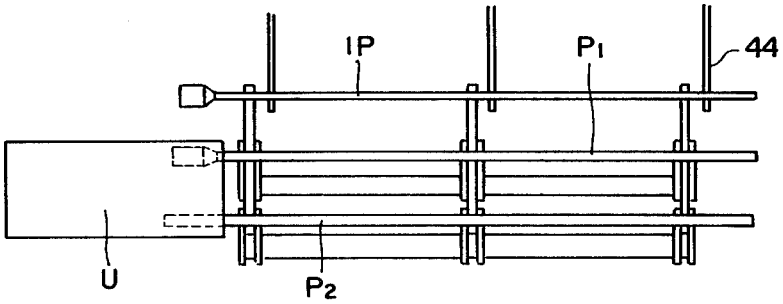
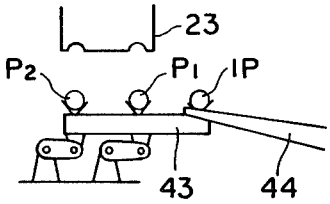

HORIZONTAL TUBE UPSETTER

BACKGROUND OF THE INVENTION

1. Field of the Invention

This invention relates to an upsetter for upsetting end portions of elongated materials of, for example, steel and like material, and more particularly to improvements in clamp dies for upsetters with a horizontal die arrangement.

2. Description of the Prior Art

Upsetters basically consist of a grip mechanism which holds one end of a workpiece against slipping deviations when subjected to a thust in the upsetting stage, by gripping the workpiece by part of a pair of radially split dies the other part of which define the outer shape of the product when closed, and an upsetting mechanism which upsets the workpiece by means of an axially reciprocable upsetting die. The upsetting machines are largely classified into two types depending upon the direction in which the dies are split.

The first is a vertical type which, as shown in FIGS. 1 and 2, has vertically split dies 1 and 2 which are opened and closed in the horizontal direction by a drive mechanism 8 provided on one side of the dies. The vertical upsetter has a U-shaped frame 3 which is open on the upper side and supports the aforementioned dies 1 and 2 on the inner side. In order to prevent the frame 3 from being expanded on the upper open side at the time of gripping a work member 4, a cross tie rod 5 is provided perpendicularly along the upper open side of the frame 3.

Therefore, in the vertical type upsetter with the dies 1 and 2 enclosed on four sides as seen in the direction of arrow II of FIG. 2, there invariably arises the necessity for moving work members 4 over a large distance on the front side of the machine when feeding and extracting them before and after the upsetting operation.

More specifically, as seen in FIGS. 1 and 2, a blank tube 4 which has its end portion heated in a furnace 7 is transferred laterally over a certain distance for delivery to the working position of the upsetter as indicated by arrow I and then moved in the longitudinal direction for insertion into the upsetter as indicated by arrow II. Work member 4 which has been gripped in the upsetter is then lowered stepwise as indicated by arrow III to undergo the primary and secondary operations in the dies 1 and 2. Upon completion of upsetting operation, the work member 4 is drawn out of the upsetter by moving the same longitudinally backward over a substantial distance as indicated by arrow IV and then lifted to the initial level as indicated by arrow V, followed by a lateral movement over a large distance as indicated by arrow VI for transfer to the location of the next operation.

Consequently, the operation by a vertical upsetter entails transfer of the heated or upset work member 4 in the lateral direction as indicated by arrows I and VI within a short time period in addition to substantial longitudinal movements in the directions of arrows II and IV and the vertical movements in the directions of arrows III and V. Namely, it has a drawback in that it requires complicated and costly transfer or handling mechanisms for moving the work member in lateral, longitudinal and vertical directions. Besides, there has to be provided a long path of travel in total to cope with the large breadth of the upsetter with the side drive mechanism and the transfer of work in three directions, resulting in a prolonged period of time for one cycle of operation, lower productivity and high production cost.

Especially in the case of hot forging, the work members cool off during transfer, so that larger power and energy sources are required for the forming operation and the number of consecutive operations which are possible per single heating is limited. Consequently, due to the difficulty of completing the forming operation with only one heating stage, there arise the necessities of die replacement and reheating of the work before finishing the forming process.

As seen in FIG. 3 which diagrammatically illustrates a drive mechanism and a die assembly of another vertical type upsetter, the respective clamp dies which are operated by a clutch/brake mechanism 6 are not capable of clamping simultaneously a plurality of works which have large variations in outside diameter. More particularly, the movable dies 2 consist of an upset die section 2A and a clamp die section 2B, and similarly the stationary dies 1 consist of an upset die section 1A and a clamp die section 1B, arranged such that the movable dies 2 in the successive positions are actuated simultaneously and that work members are upset by driving an upset punch 10 through a clutch/brake mechanism 10A and a drive mechanism 10B including a crank 9. However, it has been difficult to improve the productivity since work members with large variations in outside diameter have to be worked one by one, coupled with the complicated path of travel.

These drawbacks will be understood by reference to FIG. 4, wherein indicated at reference number 11 is an upsetter, at 12 a skid feeder, at 13 a work lift and at 14 a work kicker. As illustrated in FIG. 4(*a*), a blank tube type work member 4 is delivered in front of the upsetter 11 as denoted by arrow I and then loaded into the machine as indicated by arrow II of FIG. 4(*b*), closing the movable die 2 toward the stationary die 1 to clamp the work member 4 therebetween as shown by the reference character A. In the next phase of operation, a punch is advanced as indicated by the reference character B to effect the forging at the preceding position. In the succeeding phases, the movable die 2 is opened as depicted in FIG. 4(*c*) and the work is shifted and positioned in the die at the second position shown in FIG. 4(*d*), forging the work member in a similar manner as illustrated in FIG. 4(*e*). Thereafter, the forged work member 4A is drawn out of the upsetter and lifted up for transfer to a next point of operation. Thus, each work member has to be moved along a complicated path of travel which requires a long time per cycle of operation, and it is difficult to clamp simultaneously a plurality of tubes with large variations in outside diameter since the clamp dies of the respective stages are operated integrally, unavoidably inviting a material drop in productivity.

Known also in the art is the so-called horizontal type upsetter which overcomes the problem of a long and complicated path of travel inherent in the vertical type upsetter described above. As illustrated in FIG. 5, the horizontal type upsetter is provided with dies 16 which are split horizontally. The dies are opened and closed vertically by a drive mechanism 17 which is mounted over the die assembly, so that the upsetter has a reduced width as compared with the vertical type.

As shown in FIG. 5, in the horizontal type upsetter, work members which are passed horizontally through part of die 16 are moved back and forth in the longitudinal direction to avoid interference of pull rods 18 which produce the gripping force of the dies 16. That is, the works which are fed into the machine in a slightly retracted position to be clear of the pull rod 18 are pushed in and then fed laterally to undergo sequentially the forging in the first and second dies. Upon finishing the forming operation, the work member are retracted again to avoid contact with the other pull rod 18 and moved laterally out of the machine for transfer to the location of the next operation.

The horizontal type upsetter which has a smaller width needs a shorter path of travel and thus contributes to shortening the cycle time of the forming operation and enhancing productivity as compared with the vertical type. Another advantage of the horizontal type upsetter resides in the fact that the transfer and handling mechanism can be simplifed to a significant degree as the main routes of transfer are all on the same horizontal plane. Further, in contrast to the vertical type which is closed on four sides, the horizontal type upsetter permits observation the conditions of the products from three sides when the dies are opened and accordingly it has an advantage that some suitable measures can be taken promptly to remove the cause of any defect as soon as a defective product comes out.

Although the path of work travel in the horizontal upsetter is two-dimensional, that is to say, in one horizontal plane, the works have to be moved longitudinally backward or to the left as seen in FIG. 5 to evade collision with the pull rods 18 which can move only a small distance in the longitudinal direction. Namely, there still remains the problem of utilizing a complicated transfer or feed mechanism in the known horizontal upsetter which does not permit linear transfer of the work members and products.

Further, the clamp dies in the successive positions are arranged to be operated integrally or jointly even in the horizontal type upsetter, so that they cannot clamp simultaneously a plurality of work members which have large variations in outside diameter, thus leaving the problem of low productivity unsolved.

SUMMARY OF THE INVENTION

With the foregoing situations in view, the present invention has as its object the provision of a horizontal upsetter employing a plurality of dies of the same shape, which are operated separately for clamping accurately a corresponding number of similar work members irrespective of dimensional variations.

It is another object of the present invention to provide a horizontal upsetter as mentioned above, which can serve to simultaneously upset a plurality of work members or progressively upset work members into a desired form successively in a number of steps.

It is still another object of the present invention to provide a horizontal upsetter of the sort mentioned above, which has a simplified transfer mechanism.

According to the present invention, there is provided a horizontal upsetter having a bed, a grip tong having one end thereof pivotally connectd to one end of the bed through a shaft, a row of horizontally split dies opposingly mounted at the other free ends of the bed and grip tong and including upper movable dies and lower fixed dies each having an upset die section and a clamp die section, the upsetter having a number of piece dies separately constituting the clamp die sections of the upper movable dies; and pressurizing cylinders for operating the clamp dies sections independently of each other.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 1 is a plan view of a conventional vertical type upsetter;

FIG. 2 is a side sectional elevational view of the same upsetter;

FIG. 5 is a side sectional elevational view of a conventional horizontal type upsetter;

FIG. 7(*a*) is a sectional view taken along line A—A of FIG. 6;

FIG. 7(*b*) is a view similar to FIG. 7(*a*) but showing a conventional counterpart;

DETAILED DESCRIPTION OF THE PREFERRED EMBODIMENTS

Figure 3:
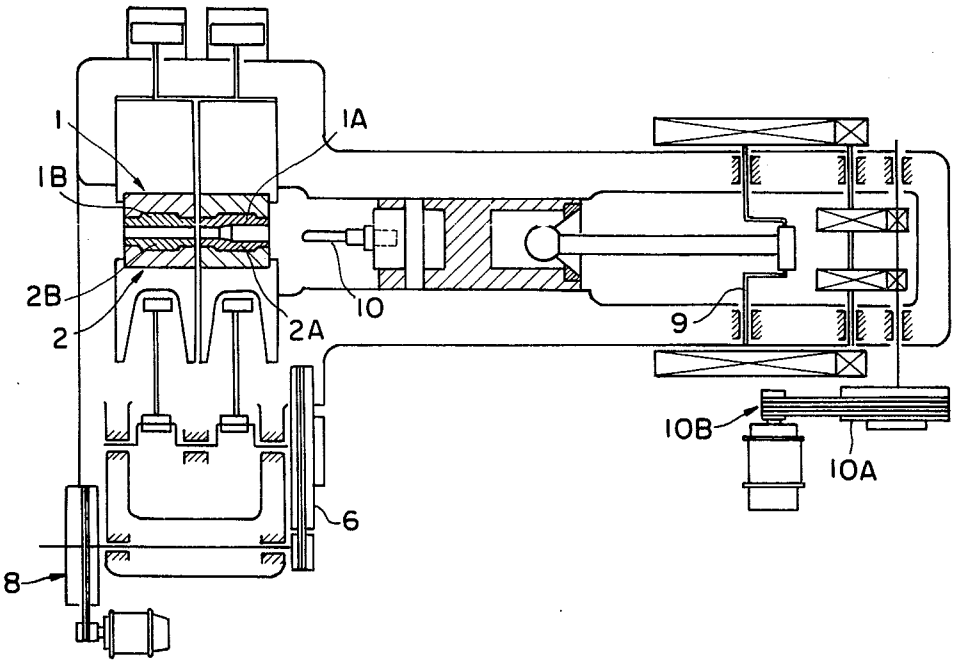
FIGURE 3 PRIOR ART
FIG. 3 is a diagrammatic view of a drive mechanism and a die assembly of a vertical type upsetter which differs from that shown in FIGS. 1 and 2.
Figure 4A:
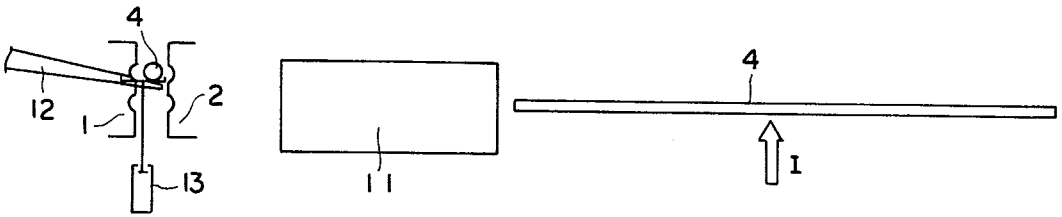
FIGURE 4(a) PRIOR ART
FIGS. 4(*a*) to 4(*f*) are diagrammatic views illustrating various phases of work transfer and upsetting operation by the upsetter of FIGS. 1 to 3.
Figure 4B:
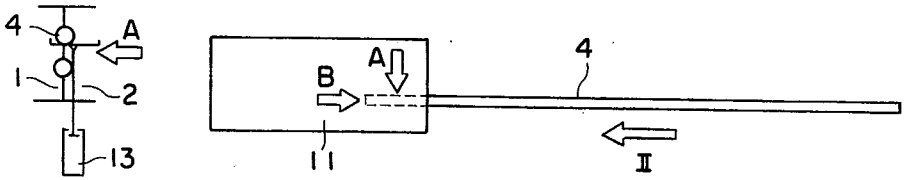
FIGURE 4(b) PRIOR ART
Figure 4E:
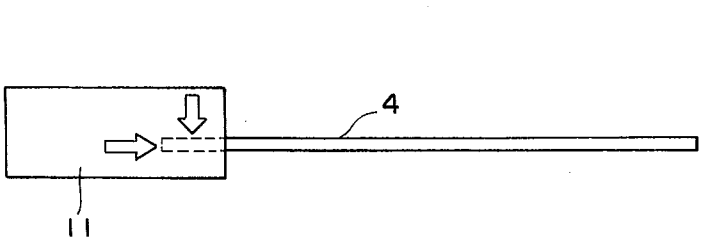
FIGURE 4(e) PRIOR ART
Figure 4C:
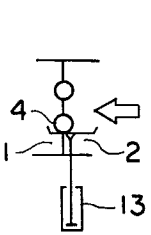
FIGURE 4(c) PRIOR ART
Figure 4D:
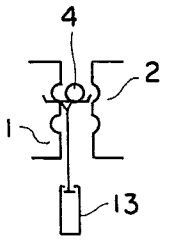
FIGURE 4(d) PRIOR ART
Figure 4F:
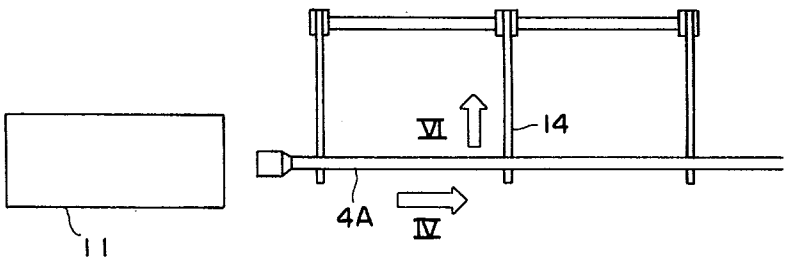
FIGURE 4(f) PRIOR ART
Figure 4D:
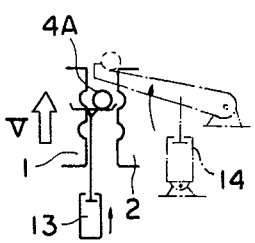
FIGURE 4(d) PRIOR ART

Referring now to FIGS. 6 to 9, there is shown a horizontal type upsetter according to the present invention, which includes a bed 20 and a grip tong 21 which are pivotally connected at one end of each thereof through a horizontal shaft 22. In the particular embodiment shown, a pair of movable dies are mounted side by side on the gripping tong 21, each including an upset die section 23A and a clamp die section 23B. Designated by reference number 24 are stationary dies which are mounted on the bed 20 in opposing relation with the movable dies 23, each stationary die having an upset die section 24A and a clamp die section 24B.

As shown in FIG. 7(*a*), the clamp dies 23B of the movable dies 23 include piece dies 123A and 123B which are separately operated by opposingly provided hydraulic cylinders 25A and 25B.

To explain the die arrangement more specifically with reference to FIG. 7(*a*), first and second split die holders 26A and 26B which are suspended from the head of the gripping tong 21 by a plurality of bolts 27A and 27B are movable downwardly along the straight shank portions of the bolts 27A and 27A' (not shown) against the action of springs 28A and 28A' (not shown) when pressure is applied to the hydraulic cylinders 25A and 25B. Die holders 26A and 26B are retracted upward by the springs 28A and 28A' as soon as the cylinders 25A and 25B are drained.

Clamp dies 31A and 31B, which are of the same shape in the particular embodiment shown, are fixedly mounted on second split die holders 30A and 30B which are fixed to the first split die holders 26A and 26B by positioning bolts 29A and 29B, respectively. Namely, according to the present invention, the horizontally juxtaposed clamp dies 31A and 31B which are driven by a single hydraulic cylinder 25 through common and unitary first and second die holders 26 and 30 in the conventional horizontal upsetter shown in FIG. 7(*b*) are split into a plurality of piece dies 123A and 123B as shown in FIG. 7(*a*) and respectively driven by hydraulic cylinders 25A and 25B for operations independent of each other.

Figure 6:
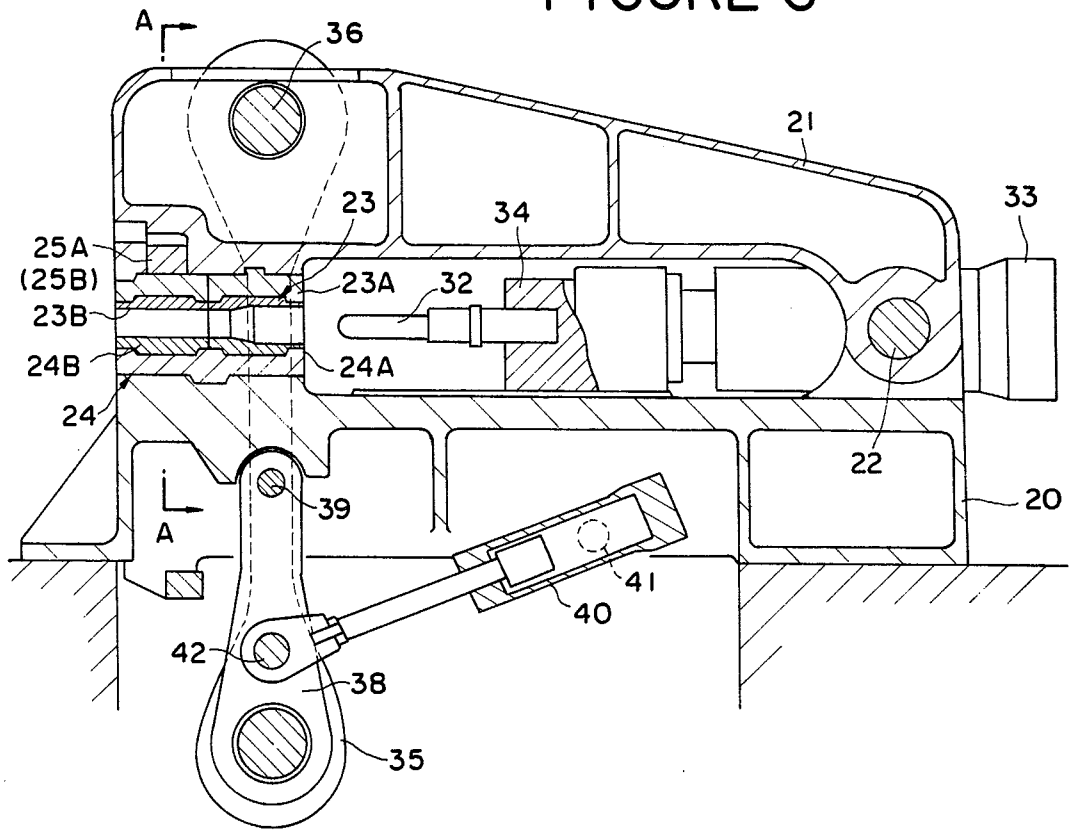
FIG. 6 is a side sectional elevation of an upsetter according to the present invention in a die closing phase of operation.
Figure 8:
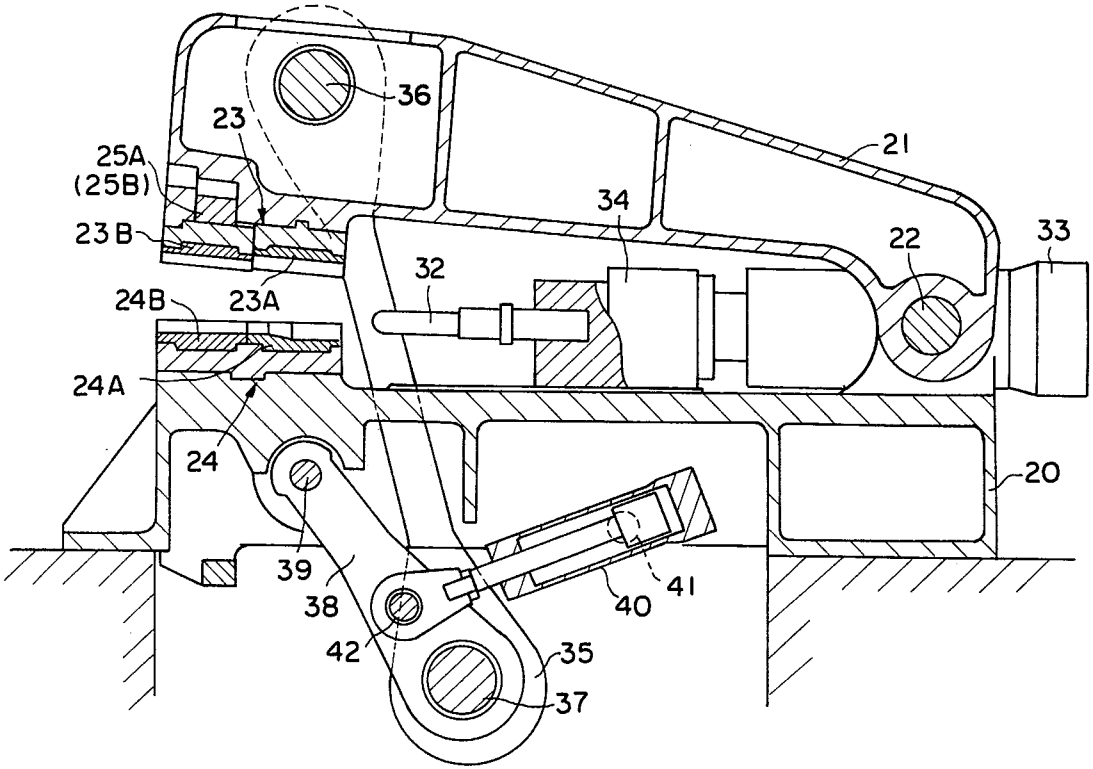
FIG. 8 is a sectioned side elevational view of the upsetter of the invention in a die opening phase of operation.
Figure 9:
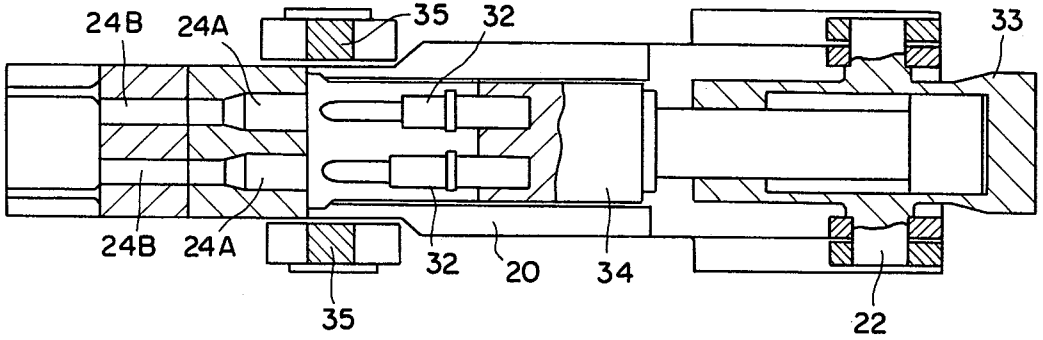
FIG. 9 is a sectioned plan view showing details of fixed dies.

Indicated by reference number 32 in FIGS. 6, 8 and 9 are punches for the upset dies which are retractably protrudable into the dies 23 and 24 by the stroking action of a hydraulic piston cylinder 33. Reference number 35 denotes a pair of pull rods which have one end of each thereof pivotally supported on the tong head through a shaft 36 and the other ends pivotally connected to grip links 38 through a shaft 37, each grip link 38 being pivotally supported on the bed at its upper end through a shaft 39. A gripping hydraulic cylinder 40 pivotally supports the respective casings on the bed through a shaft 41, with the fore ends of the piston rods being pivotally connected to the gripping links 38 through a shaft 42. When the piston rod of the hydraulic cylinder 40 is extended, the shafts 36, 39 and 42 are aligned in a vertical plane, clamping and closing the movable and fixed dies to each other by a relative closing movement. As the piston cylinder 40 is contracted, the fixed and movable dies 24 and 23 are set apart by a relative opening movement as shown in FIG. 8. With this gripping mechanism, the work members can be fed linearly across the die portions without colliding against the pull rods 35.

Although a hydraulic cylinder is employed as mechanism for driving the grip links 38 in the foregoing embodiment, they may be substituted with a pneumatic cylinder, hydraulic motors, electric motor or a mechanical drive such as a crank or toggle mechanism or a link mechanism incorporating a crank or toggle, as long as the links 38 are rotated with a necessary power.

Further, in the particular embodiment shown, the upsetter is provided with a pair of upper dies (movable dies) and a pair of lower dies (stationary dies) which are horizontally juxtaposed and each includes an upset die section 24A and a clamp die section 24B as seen particularly in FIG. 8 which representatively illustrates the lower dies. However, the upsetter may be provided with rows of more than two upper and lower dies, for example, with three movable dies and three fixed dies, clamping a work member by center or intermediate dies of a smaller diameter or clamping work members simultaneously and independently by outer dies of a larger diameter.

Figure 10A:
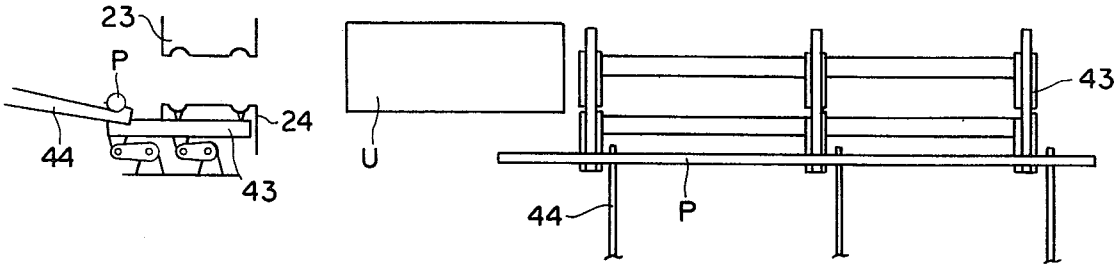
FIGS. 10(*a*) to 10(*f*) are diagrammatic views showing various phases of the operation by the upsetter according to the invention.
Figure 10B:
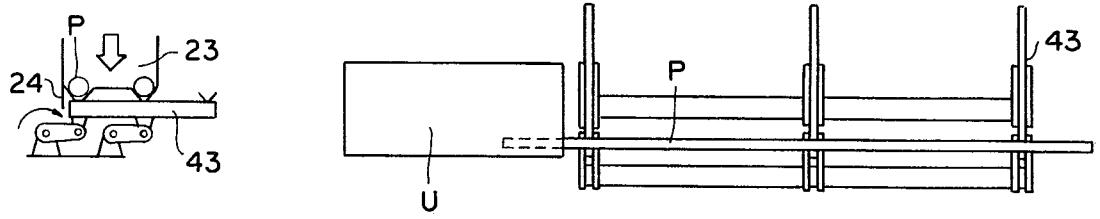

FIGS. 10(*a*) to 10(*f*) illustrate various phases of the work transferring aand upsetting operations by the upsetter according to the present invention, using a walking beam transfer mechanism 43. More particularly, a tube P which has been heated while delivered by a tube transfer skid 44 is shifted over to a tube handler 43 as shown in FIG. 10(*a*). The arms of the tube handler 43 are then swung forward to feed the tube P into a lower die in the initial working position of the upsetter U, whereupon the dies are closed by expanding the piston cylinder 25A as described hereinbefore to grip the tube P in cooperation with the clamp die 31A. In the next phase of operation, the punches 32 are driven into the dies 23 and 24 by extending the piston cylinder 33 to complete the upsetting operation of the first stage.

There then follows the steps of contraction of the piston cylinder 40, draining of the cylinder 25A and contraction of the piston cylinder 33 to open the dies as shown in FIG. 10(*c*), while the next tube P1 is delivered to the tube handler 43 as shown in FIG. 10(*c*). The preceding tube P which has undergone operation of the first stage and the succeeding tube P1 are then fed respectively to the dies of the second and first positions by the tube handler 43 and upset by actuating the gripping and punch drive cylinders in the same manner as described above. In this instance, the tubes P and P1 are clamped securely even if they have different outside diameters, since the movable dies are constituted by piece dies 123A and 123B which are separately clamped by the cylinders 25A and 25B. While the tubes P and P1 are simultaneously undergoing the upsetting operations of the first and second stages as illustrated in FIG. 10(*e*), a third tube P2 is delivered to the tube handler 43.

Upon completion of the simultaneous upsetting operation, the first tube, that is to say, the upset product is discharged from the machine by cooperation of the tube handler 43 and an ejecting skid 44, while the second and third tubes P1 and P2 are advanced to the dies of the second and first stages, respectively. Thereafter, the same operation is repeated to upset the succeeding tubes through the dies in the first and second positions.

Figure 11A:
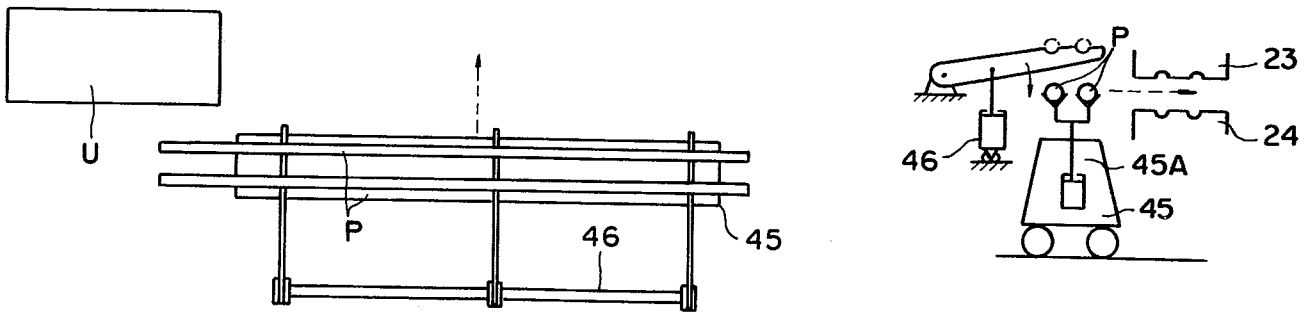
FIGS. 11(*a*) to 11(*c*) are diagrammatic views showing operation by a modified embodiment of the invention.
Figure 11B:
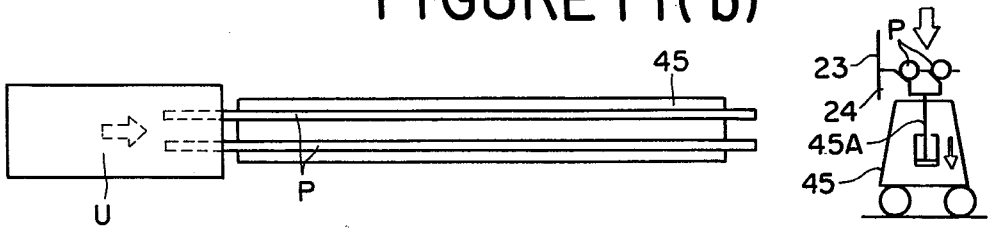
Figure 11C:
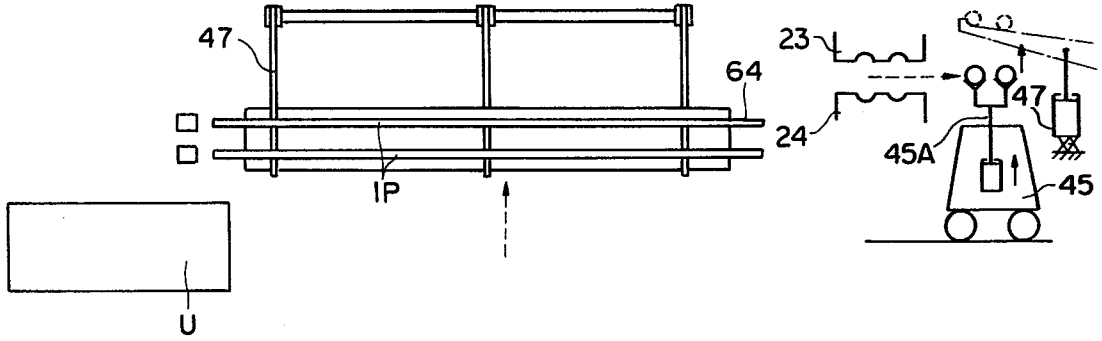

Referring to FIGS. 11(*a*) to 11(*c*), the description is now directed to a simultaneous one-step upsetting operation of a plurality of work members, using a carriage conveyor 45, a tube feed skid 46 and an ejecting kicker 47. It is to be understood that, although the following description illustrate the simultaneous upsetting operation of a couple of tubes, three or more tubes can be handled and upset in a similar manner.

In the initial phase, a couple of heated tubes P are delivered through a skid 45A to a tube receptacle of a carriage 45 with a lift cylinder 45A, which is located in a stand-by position in front of the upsetter U as shown in FIG. 11(*a*). Carriage 45 is then moved automatically or manually pushed in the direction indicated by the arrow to insert the tube ends in the horizontally juxtaposed dies 23 and 24 of the upsetter U, followed by upsetting as illustrated in FIG. 11(*b*). In this instance, even if there is a difference in outside diameter between the two tubes, they are respectively clamped by the piece dies with a sufficient force which can cope with the axial force of the punches.

After simultaneously upsetting the two tubes in the above-described manner, the dies are opened and the lift cylinder 45A is extended upwardly as shown in FIG. 11(*c*) to receive the upset products on the carriage 45, sending the same forward operation of the kicker 47.

As is clear from the foregoing description, the upsetter of the present invention is provided with a plurality of movable dies and a plurality of fixed dies in horizontal rows with upset dies (23A, 24A) and clamp dies (23B, 24B) in opposing relation, and characterized in that the clamp dies (23B, 24B) of the movable dies (23) are constituted by independently movable piece dies (123A, 123B) which are separately operated by hydraulic cylinders (25A, 25B). The upsetter with such a die arrangement has the following advantages.

The provision of the separately operable clamping dies in the successive working positions of the upsetter makes it possible to upset simultaneously a plurality of blanks by the use of a corresponding number of dies of the same shape or to upset works one after another progressively through a number of upsetting dies of different stages, improving the productivity to a marked degree.

The works are clamped separately by a clamping force which is great enough for overcoming the upsetting force no matter whether the works contain variations in outside diameter or larger tolerance while securely closing the upset dies to ensure high quality of the products in addition to the improvement in productivity.

Obviously, numerous modifications and variations of the present invention are possible in light of the above teachings. It is therefore to be understood that within the scope of the appended claims, the invention may practiced otherwise than as specifically set forth herein.

What is claimed as new and desired to be secured by Letters Patent of the United States is:

1. A horizontal upsetter having a bed, a grip tong having one end thereof pivotally connected to one end of said bed through a shaft, a row of horizontally split dies mounted opposingly across the outer free ends of said bed and grip tong and consisting of upper movable dies and lower fixed dies each of the upper movable dies and lower fixed dies having an upset die section and a clamp die section to define a clamping cavity between said clamp die sections and an upset cavity between said upset die sections, a punch for each said upset cavity, said upsetter comprising:

a punch for each of said upset cavities, each said punch being movable into a respective upset cavity to upset a workpiece;

a plurality of piece dies which separately comprise said clamp die sections of said upper movable dies;

a plurality of pressurizing cylinders for operating said clamp die sections through said separate piece dies independently of each other to clamp workpieces between said clamp die sections;

at least one pull rod having one end pivoted at a first pivot axis on said grip tong;

at least one grip link having one end pivoted at a second pivot axis on said bed and a second end pivoted at a third pivot axis to a second end of said grip link; and actuating means connected to one of each said pull rod and said grip link for pivoting said pull rod and said grip link, whereby said dies are opened and closed.

2. A horizontal upsetter as set forth in claim 1, wherein each of said piece dies comprise a plurality of first split die holders vertically movably supported on said grip tong and driven by said pressurizing cylinders, and a plurality of second split die holders supported by said first split die holders.

3. A horizontal upsetter as set forth in claim 2, wherein each of said pressurizing cylinders includes a piston and are formed in said grip tong head and said first split die holders are supported in suspension on said grip tong and connected to said piston of each of said pressurizing cylinders.

4. The upsetter of claim 1 wherein said actuating means is pivotally connected between said bed and one said grip link.

5. The upsetter of claim 1 wherein said actuating means comprises:

a hydraulic cylinder for each said pull rod and grip link, each said cylinder being pivoted to said bed; and a piston for each said cylinder, each said piston being pivoted to a midportion of one said grip link.

6. The upsetter of claim 1 wherein said first, second and third axes are parallel and wherein a plane containing said first and second pivot axes passes through said dies.

7. The upsetter of claim 6 wherein said plane contains said third pivot axis only when said dies are fully closed.

8. The upsetter of claim 5 wherein said first, second and third axes are parallel and wherein plane containing said first and second pivot axes passes through said dies.

9. The upsetter of claim 8 wherein said plane contains said third pivot axis only when said dies are fully closed.

10. The upsetter of claim 7 wherein said pull rod, said grip link and said actuating means are constructed so as to move said third axis to a position between said plane and a vertical plane containing the pivotal axis of said grip tong on said bed when said dies are opened, whereby said pull rod does not interfere with lateral feeding of workpieces to said dies.

11. The upsetter of claim 9 wherein said pull rod, said grip link and said actuating means are constructed so as to move said third axis to a position between said plane and a vertical plane containing the pivotal axis of said grip tong on said bed when said dies are opened, whereby said pull rod does not interfere with lateral feeding of workpieces to said dies.

* * * * *